US008868422B2

(12) United States Patent
Hirabayashi et al.

(10) Patent No.: US 8,868,422 B2
(45) Date of Patent: Oct. 21, 2014

(54) STORING A REPRESENTATIVE SPEECH UNIT WAVEFORM FOR SPEECH SYNTHESIS BASED ON SEARCHING FOR SIMILAR SPEECH UNITS

(75) Inventors: Gou Hirabayashi, Kanagawa-ken (JP); Takehiko Kagoshima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 543 days.

(21) Appl. No.: 12/880,796

(22) Filed: Sep. 13, 2010

(65) Prior Publication Data

US 2011/0238420 A1 Sep. 29, 2011

(30) Foreign Application Priority Data

Mar. 26, 2010 (JP) ..... 2010-073694

(51) Int. Cl.

| | |
|---|---|
| ***G10L 13/00*** | (2006.01) |
| ***G10L 13/08*** | (2013.01) |
| ***G10L 13/06*** | (2013.01) |
| ***G10L 13/033*** | (2013.01) |
| *G10L 13/04* | (2013.01) |

(52) U.S. Cl.

CPC ..... *G10L 13/08* (2013.01); *G10L 13/06* (2013.01); *G10L 13/04* (2013.01); *G10L 13/033* (2013.01)

USPC ..... 704/260; 704/258; 704/268

(58) Field of Classification Search

USPC ..... 704/258–269, E13.001–E13.014

See application file for complete search history.

(56) References Cited

U.S. PATENT DOCUMENTS

| | | | | |
|---|---|---|---|---|
| 6,496,801 | B1 * | 12/2002 | Veprek et al. | 704/260 |
| 6,823,309 | B1 * | 11/2004 | Kato et al. | 704/267 |
| 6,847,931 | B2 * | 1/2005 | Addison et al. | 704/260 |
| 6,856,958 | B2 * | 2/2005 | Kochanski et al. | 704/260 |
| 6,961,704 | B1 * | 11/2005 | Phillips et al. | 704/268 |
| 2005/0119890 | A1 * | 6/2005 | Hirose | 704/260 |
| 2006/0136214 | A1 * | 6/2006 | Sato | 704/265 |
| 2006/0224391 | A1 * | 10/2006 | Tamura et al. | 704/268 |
| 2009/0048844 | A1 * | 2/2009 | Morinaka et al. | 704/267 |

FOREIGN PATENT DOCUMENTS

| | | | | |
|---|---|---|---|---|
| EP | 0848372 | A2 * | 6/1998 | G10L 5/02 |
| JP | 07-210184 | | 8/1995 | |

* cited by examiner

*Primary Examiner* — Jesse Pullias

(74) *Attorney, Agent, or Firm* — Amin, Turocy & Watson, LLP

(57) ABSTRACT

According to one embodiment, a method for editing speech is disclosed. The method can generate speech information from a text. The speech information includes phonologic information and prosody information. The method can divide the speech information into a plurality of speech units, based on at least one of the phonologic information and the prosody information. The method can search at least two speech units from the plurality of speech units. At least one of the phonologic information and the prosody information in the at least two speech units are identical or similar. In addition, the method can store a speech unit waveform corresponding to one of the at least two speech units as a representative speech unit into a memory.

7 Claims, 15 Drawing Sheets

TEXT 1 HACHIOJI-INTER E MUKATTEIRUKATANI, JIKOJYUTAI NO JYOHODES

TEXT 2 NIIGATA HOUMEN E MUKATTEIRUKATANI,HACHIJIGENZAINO JYUTAINO JYOHODES

TEXT 3 KAMATA HOMEN E MUKATTEIRUKATANI, SHIZENJYUTAINO JYOHODES

FIG. 4

(STEP S301)
| | |
|---|---|
| TEXT 4 | Turn right at the next exit, then immediately left. |
| TEXT 5 | Turn left at the next intersection. |
| TEXT 6 | Turn right at the intersection, then immediately right again. |
FIG. 10A
(STEP S302)
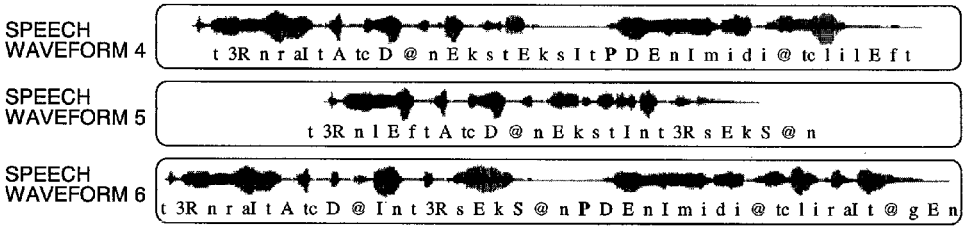
FIG. 10B
(STEP S303 - STEP S304)
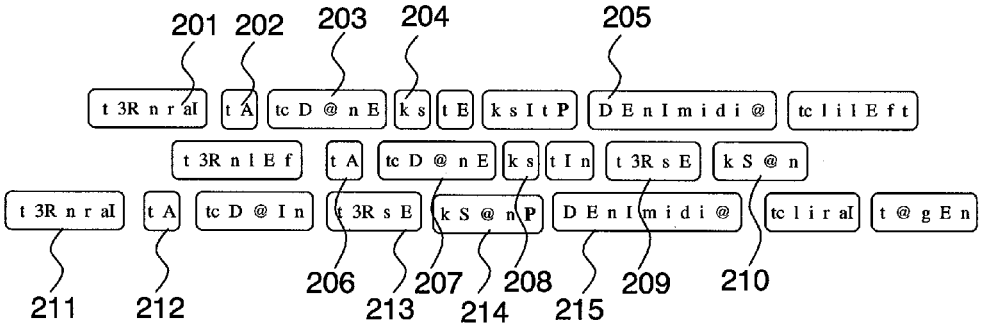
FIG. 10C
(STEP S305)
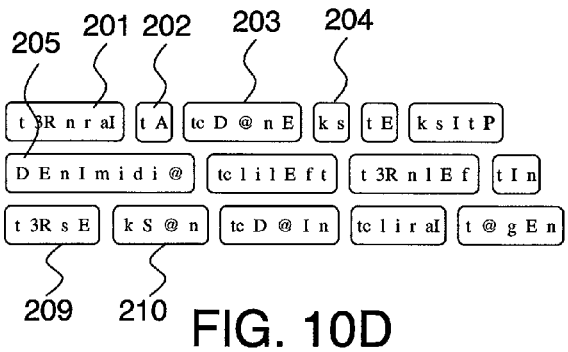
FIG. 10D

| IPA | LETTER |
|---|---|
| iː | i |
| ɪ | I |
| ɛ | E |
| æ | A |
| ɝ | 3R |
| ə | @ |
| aɪ | aI |
| aʊ | aU |
| ɔɪ | oI |
| eɪ | eI |
| ou | oU |
| t | t |
| k | k |
| d | d |
| g | g |
| f | f |
| s | s |
| ʃ | S |
| ð | D |
| m | m |
| n | n |
| l | l |
| ɹ | r |
| tʳ | tc |

FIG. 11

STORING A REPRESENTATIVE SPEECH UNIT WAVEFORM FOR SPEECH SYNTHESIS BASED ON SEARCHING FOR SIMILAR SPEECH UNITS

CROSS-REFERENCE TO RELATED APPLICATION

This application is based upon and claims the benefit of priority from Japanese Patent Application No. 2010-073694, filed on Mar. 26, 2010; the entire contents of which are incorporated herein by reference.

FIELD

Embodiments described herein relate generally to a method and an apparatus for editing speech, and a method for synthesizing speech.

BACKGROUND

As to conventional technique, a phrase concatenation based speech synthesis method is well known (For example, JP-A H07-210184 (Kokai)). In this technique, speech uttered by persons is divided into speech units (such as a word, a paragraph, or a phrase), and each speech unit is previously stored in a memory. By reading these speech units and concatenating them, a plurality of sentences are output as a speech.

In such speech synthesis method, the same speech units are used several times among a plurality of sentences. Accordingly, in comparison with the case that all sentences to be output are stored as speech, a data quantity to be stored can be reduced.

However, in the above-mentioned speech synthesis method, recorded speech is divided into speech units by a hand operation. Accordingly, speech units having high usage efficiency cannot be created.

BRIEF DESCRIPTION OF THE DRAWINGS

FIG. 4 is one example of text input to an input unit 11 in FIG. 1.

FIGS. 10A, 10B, 10C and 10D are examples of concatenation processing of English text by the speech editing apparatus 1.

FIG. 11 is a table showing correspondence between IPA (International Phonetic Alphabet) and phoneme letters in modification 1.

DETAILED DESCRIPTION

Figure 1:
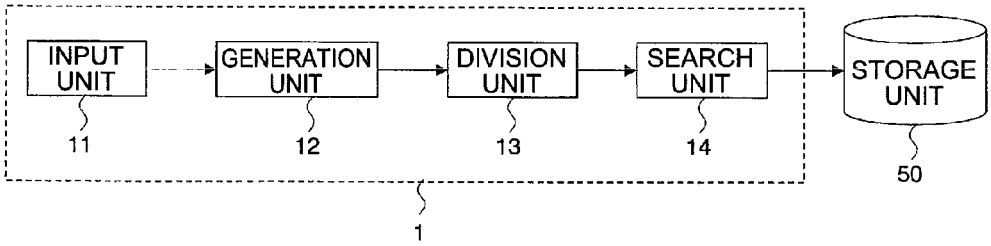
FIG. 1 is a block diagram of a speech editing apparatus according to a first embodiment.

In one embodiment, a method for editing speech is disclosed. The method can generate speech information from a text. The speech information includes phonologic information and prosody information. The method can divide the speech information into a plurality of speech units, based on at least one of the phonologic information and the prosody information. The method can search at least two speech units from the plurality of speech units. At least one of the phonologic information and the prosody information in the at least two speech units are identical or similar. In addition, the method can store a speech unit waveform corresponding to one of the at least two speech units as a representative speech unit into a memory.

Hereinafter, embodiments of the present invention will be explained by referring to the drawings. The present invention is not limited to the following embodiments.

The First Embodiment

As to a speech editing apparatus 1 of the first embodiment, by text-to-speech synthesis method, phonologic information, prosody information and a speech waveform are created from an input text by a user. The speech waveform is divided (split) into speech unit waveforms (a unit of speech waveform). Among all speech unit waveforms, at least two speech unit waveforms having identical or similar waveforms are searched, and a representative speech unit waveform (representing the at least two speech unit waveforms) is selected from them. This representative speech unit waveform is used for a speech synthesis apparatus to output by concatenating representative speech unit waveforms.

As shown in FIG. 1, the speech editing apparatus 1 includes an input unit 11, a generation unit 12, a division unit 13, and a search unit 14.

The input unit 11 inputs one or a plurality of texts from a user. The input unit 11 may be a key board or a handwriting-pad. The generation unit 12 generates a speech waveform corresponding to phonologic information or prosody information of the text (or, phonologic information and prosody information of the text) by CPU (Central Processing Unit). Moreover, the user can input a text to be desirably synthesized by a phrase concatenation based speech synthesis method, via the input unit 11.

The speech waveform represents a change of an amplitude of a speech along a time direction. The phonologic information is speech contents represented by letter or sign. The prosody information represents rhythm or intonation of speech. In the case of inputting a plurality of texts, the generation unit 12 generates the phonologic information, the prosody information and a speech waveform corresponding to teach text. For example, the generation unit 12 may generate the speech waveform using a memory (not shown in FIG. 1) storing speech units corresponding to the phonologic information and the prosody information. The generation unit 12 may be a conventional speech synthesis apparatus to generate speech waveforms from texts.

The division unit 13 divides the speech waveform into speech unit waveforms at a predetermined time by using the speech waveform, the phonologic information and the prosody information. If a plurality of texts is input to the input unit 11, the division unit 13 divides the speech waveform corresponding to each text into speech unit waveforms.

The search unit 14 searches speech unit waveforms having identical or similar waveforms from all speech unit waveforms acquired by the division unit 13. If a plurality of speech unit waveforms having identical or similar waveforms is searched, the search unit 14 selects one as a representative speech unit waveform from the plurality of speech unit waveforms, and removes the other of the plurality of speech unit waveforms into a storage unit 50. The representative speech unit waveform is any of the plurality of speech unit waveforms having identical or similar waveforms.

The generation unit 12, the division unit 13, the search unit 14, may be realized by a CPU (Central Processing Unit) and a memory (used by the CPU). Hereinafter, operation of the first embodiment is explained in detail.

Figure 2:
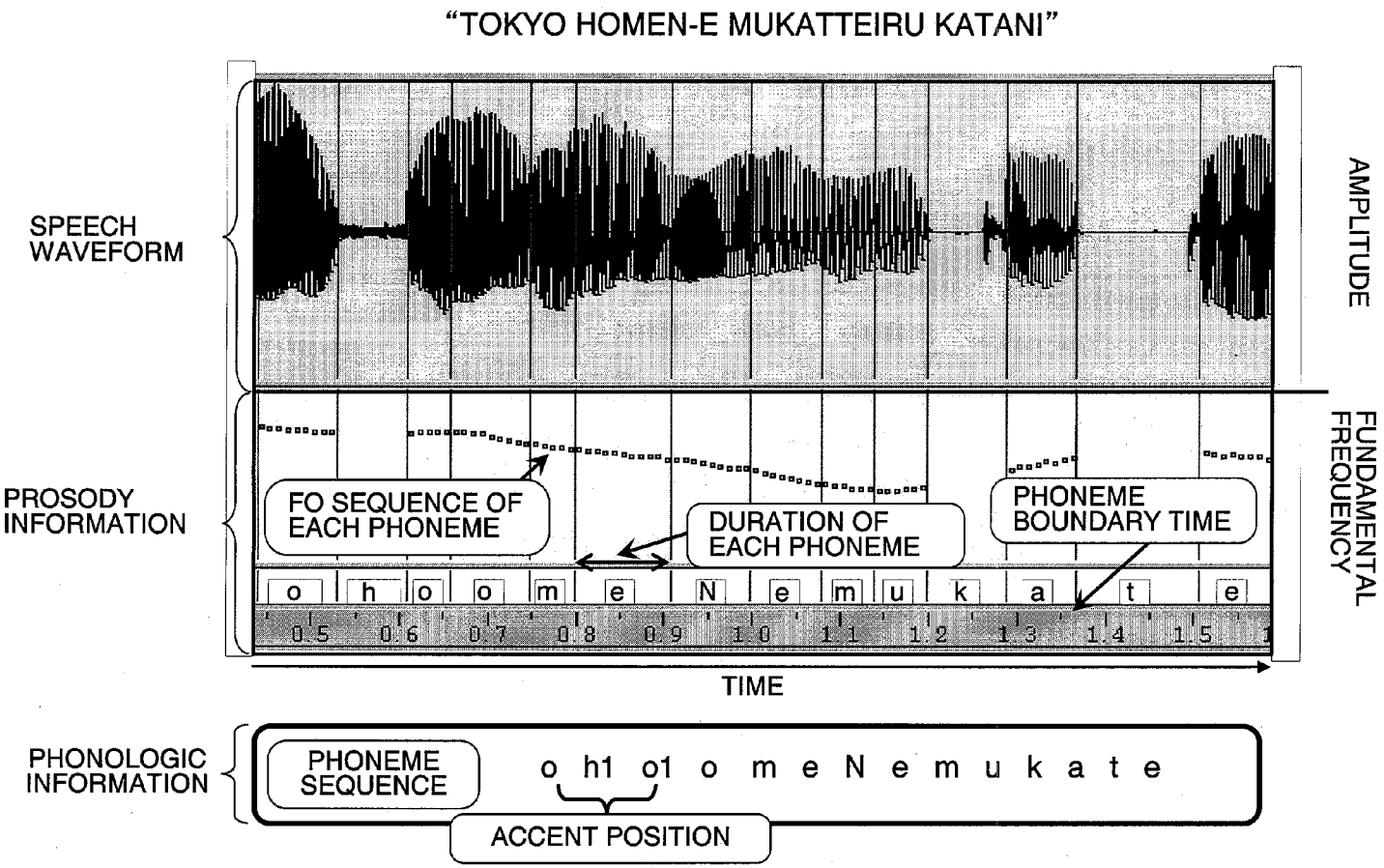
FIG. 2 is a schematic diagram of a speech waveform, prosody information and phonologic information.

In FIG. 2, as an example, a speech waveform, prosody information and phonologic information generated from a text "Tokyo homen-e mukatteiru katani" are partially shown. The speech waveform is represented as time change of amplitude of speech. The phonologic information includes a phoneme sequence (having phoneme letters corresponding to a speech waveform) and information of a phoneme having accent (it is called accent phoneme). In FIG. 2, "o h1 o1 o m e N e m u k at e" as partial phoneme sequence of "Tokyo homen-e mukatteirukatani" is shown. A phoneme "N" (capital letter) represents a syllabi nasal sound. A phoneme to which "1" is assigned is a phoneme having accent. Briefly, in this phoneme sequence, "h o" has accent. The prosody information includes a phoneme sequence, a duration of each phoneme, F0 sequence of each phoneme, and a phoneme boundary time. The F0 sequence is time change of fundamental frequency of phoneme. The phoneme boundary time is time of boundary between adjacent two phonemes.

Figure 3:
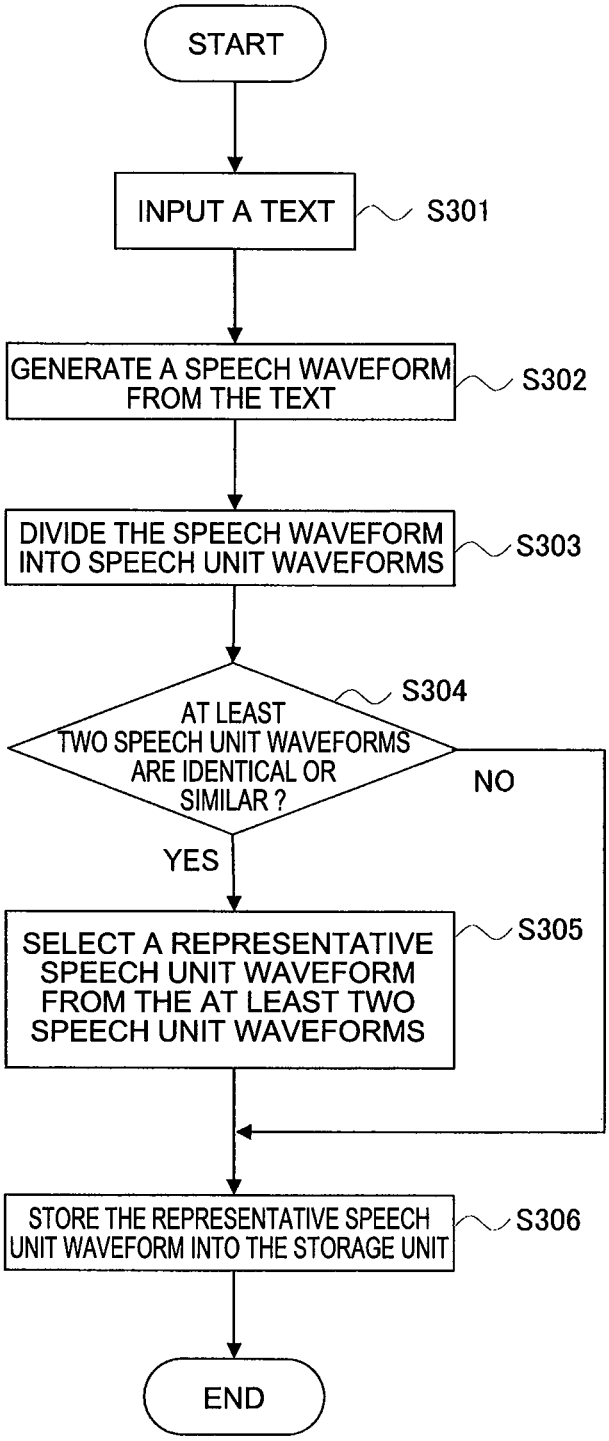
FIG. 3 is a flow chart of processing of the speech editing apparatus in FIG. 1.

In FIG. 3, the input unit 11 inputs one or a plurality of texts from a user (S301). As shown in FIG. 4, for example, the input unit 11 inputs three texts from the user, "Hachioji-inter e mukatteirukatani, jikojyutainojyohodesu" (text 1), "Niigata-homen e mukatteirukatani, hachijigenzainojyutainojyohodesu" (text 2), "Kamatahomen e mukatteirukatani, shizenjyutainojyohodesu" (text 3).

Figure 5:
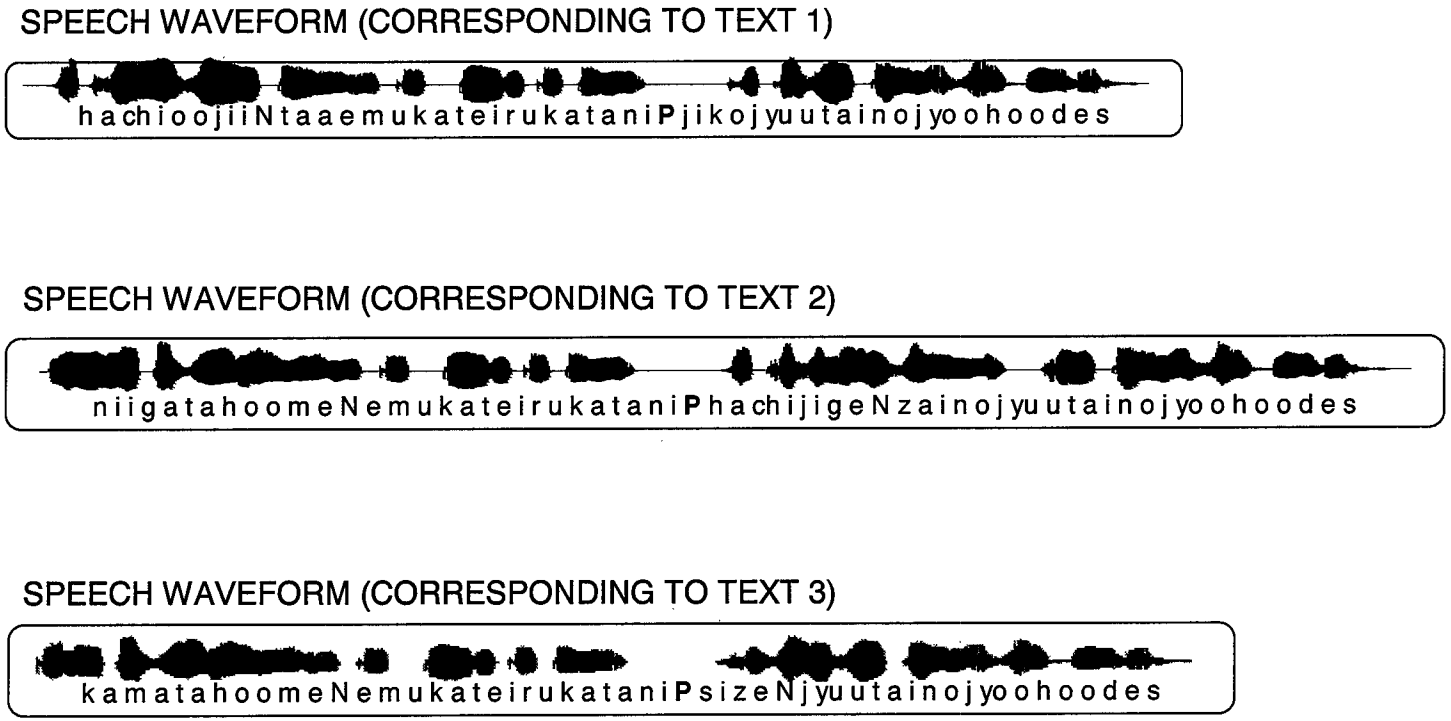
FIG. 5 is one example of speech waveforms.

The generation unit 12 determines phonologic information of three texts by linguistic analysis (such as morphological analysis and semantic analysis), determines prosody information from the phonologic information, and generates speech waveforms from the phonologic information and the prosody information (S302). In FIG. 5, a speech waveform 1 corresponds to a text 1, a speech waveform 2 corresponds to a text 2, a speech waveform 3 corresponds to a text 3. In addition to this, phoneme sequences are shown in FIG. 5. For example, the generation unit 12 determines phonologic information of text 1 by analyzing the text 1, determines prosody information from the phonologic information, and generates the speech waveform 1 from the phonologic information and the prosody information. The generation unit 12 supplies the speech waveforms to the division unit 13. If a plurality of speech waveforms is generated, the generation unit 12 supplies all the speech waveforms to the division unit 13.

Figure 6:
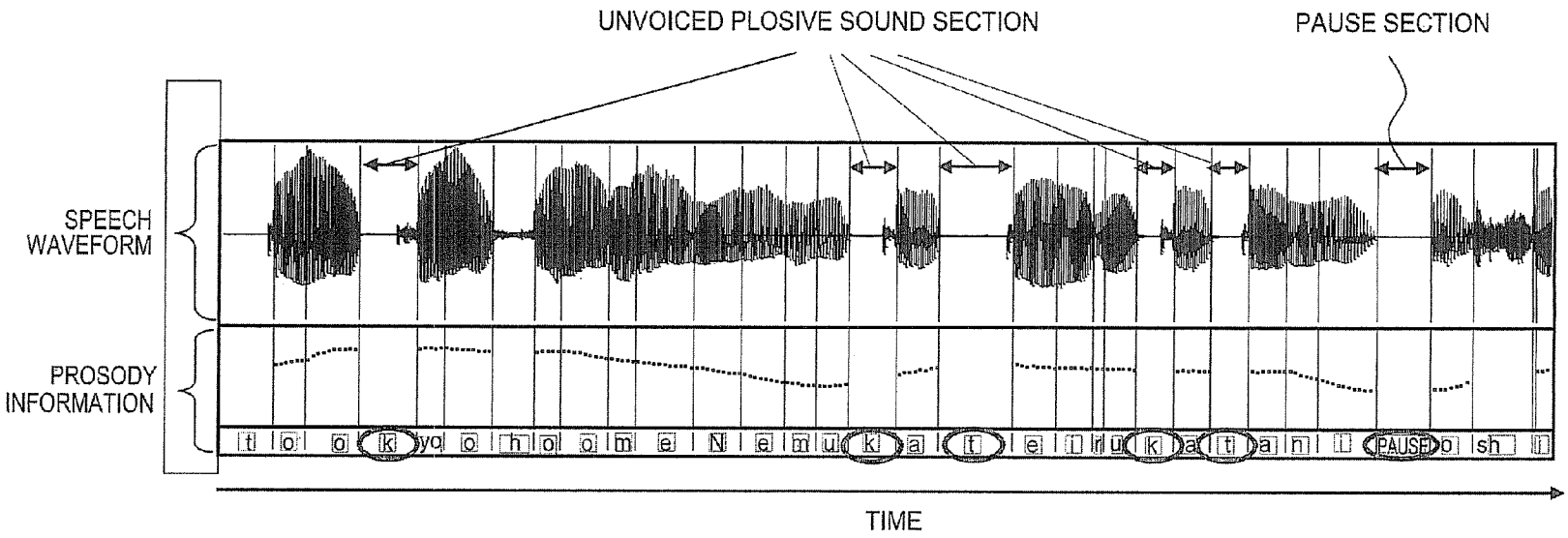
FIG. 6 is one example of dividing points of the speech waveform.

By using the phonologic information, the division unit 13 segments the speech waveform at a predetermined time, i.e., divides into speech unit waveforms (S303). In FIG. 6, a speech waveform and prosody information of "Tokyo homen-e mukatteirukatani" (FIG. 2) are shown. The division unit 13 detects a start time (or a completion time) of unvoiced plosive sound and "PAUSE" by using the phonologic information, and determines an unvoiced plosive sound section and a pause section. In the unvoiced plosive sound section and the pause section, by segmenting the section at a time that absolute value of amplitude of speech waveform is below a threshold (For example, "0"), the division unit 13 desirably divides the speech waveform into speech unit waveforms. For example, the section may be divided at a time A (the earliest time having amplitude "0") or a time B (the latest time having amplitude "0").

In this case, the unvoiced plosive sound section is a speech waveform section corresponding to phoneme of unvoiced plosive sound (such as "k", "t", "p", "ch"). The pause section is a speech waveform section corresponding to phoneme letter "PAUSE" representing silence (a punctuation mark or a period) in the text. In the first embodiment, the section is a range between an arbitrary one time and an arbitrary another time in the speech waveform.

Figure 7:
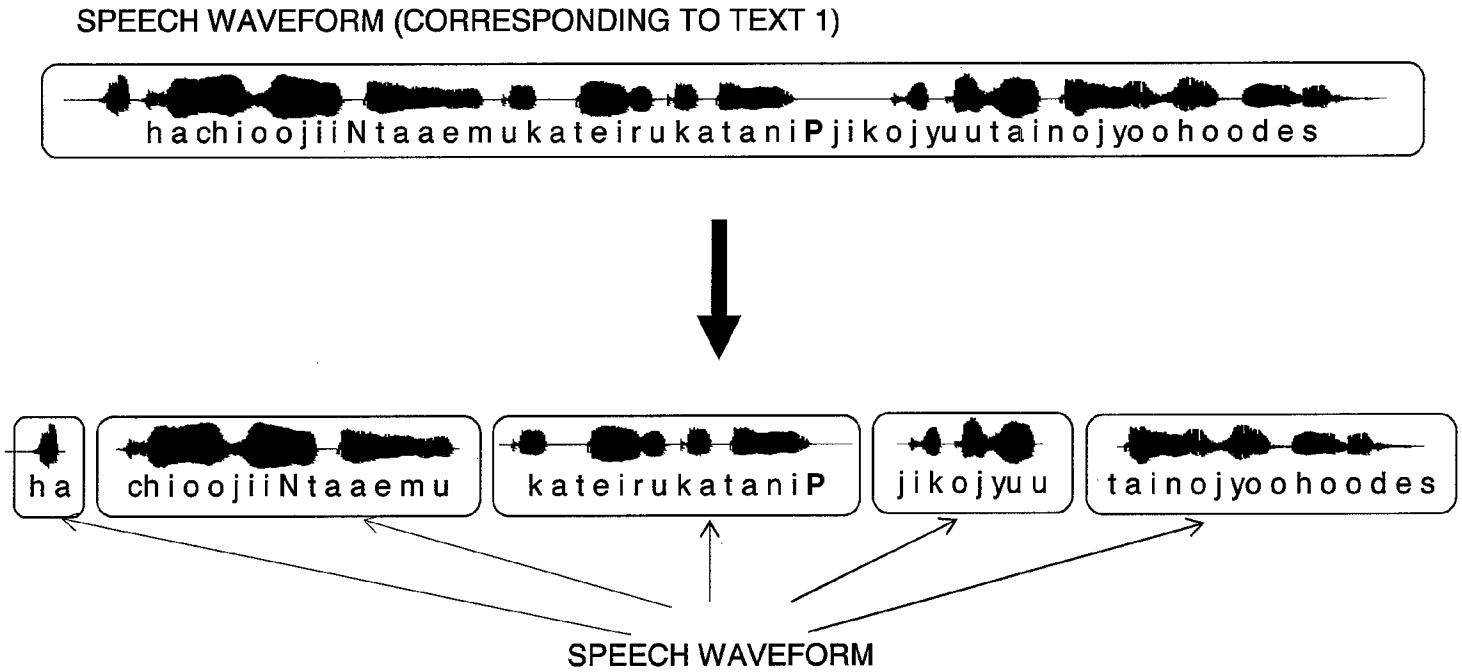
FIG. 7 is one example of division of the speech waveforms.

As shown in FIG. 7, a speech waveform 1 is divided into a plurality of speech unit waveforms. For example, the division unit 13 divides the speech waveform 1 "h a ch i o o j i i N t a a e m u k a t e i r u k a t a n i P j i k o j y u u t a i n o j yo o h o o d e s" (only phoneme sequence is shown in FIG. 6) into five speech unit waveforms "h a", "ch i o o j i i N t a a e m u", "k a t e I r u k a t a n i P", "j i k o j yu u", "t a i n o j yo o h o o d e s" at above-mentioned time (time A in the unvoiced plosive sound section and time B in the pause section). A capital letter "P" in the phoneme sequence represents phoneme letters "PAUSE".

In the same way, the division unit 13 divides the speech waveform 2 into six speech unit waveforms "n i i g a", "t a h o o m e N e m u", "k a t e i r u k a t a n i P", "h a", "ch i j i g e N z a i n o j y u u, "t a i n o j y o h o d e s". Furthermore, the division unit 13 divides the speech waveform 3 into five speech unit waveforms "k a m a", "t a h o m e N e m u", "k a t e i r u k a t a n i P", "s i z e N j yu u", "t a i n o j yo o h o o d e s".

Figure 8:
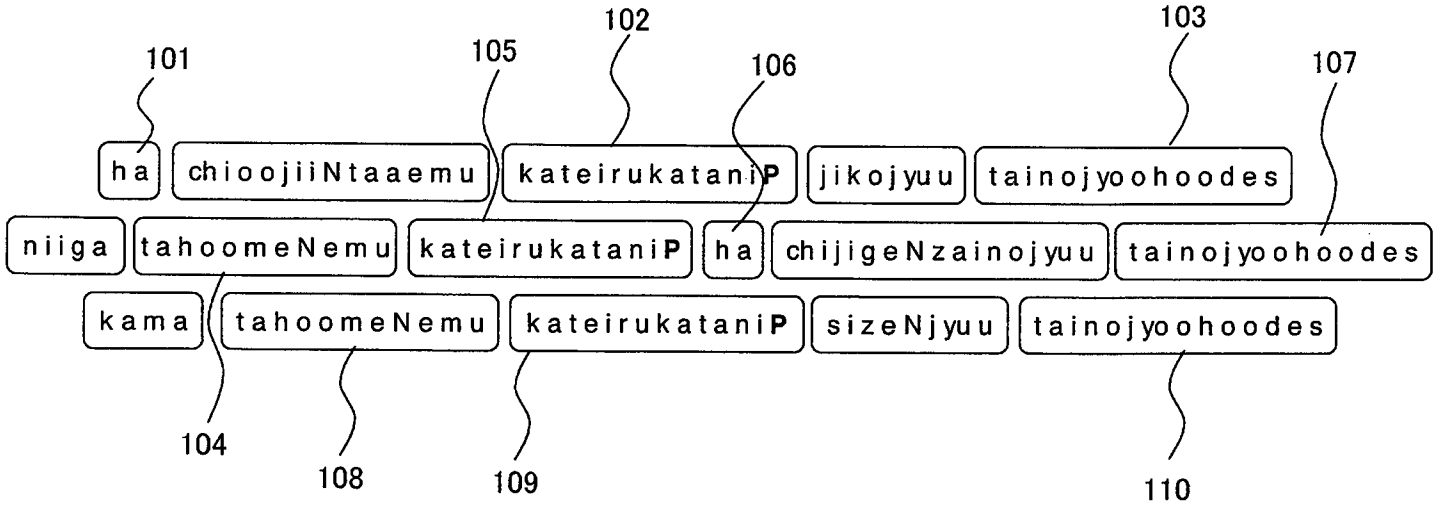
FIG. 8 is one example of speech unit waveforms.

In FIG. 8, in order to simplify, a speech unit waveform is shown as a phoneme sequence corresponding to the speech unit waveform. As shown in FIG. 8, speech unit waveforms divided from each of the speech waveforms 1, 2 and 3 exist. The division unit 13 supplies all speech unit waveforms to the search unit 14. From all speech unit waveforms, the search unit 14 selects one speech unit waveform in order, and decides whether at least two speech unit waveforms are identical or similar by comparing the one speech unit waveform with other speech unit waveforms. This processing is repeated for all pairs of two speech unit waveforms (S304). Identical waveforms represent that amplitude values of two speech unit waveforms (to be compared) at each time are identical. Similar waveforms represent that a difference between amplitude values of two speech unit waveforms (to be compared) at each time is within a predetermined range.

If decision result at S304 is No, the search unit 14 leaves the speech unit waveform, and processing is forwarded to S306. If decision result at S304 is Yes, the search unit 14 selects one speech unit waveform from at least two speech unit waveforms having identical or similar waveforms, and removes other speech unit waveforms (S305). The one speech unit waveform is called a representative speech unit waveform. The representative speech unit waveform may be randomly selected from at least two speech unit waveforms having identical or similar waveforms.

For example, in FIG. 8, as to a speech unit waveform 101 ("h a") divided from the speech waveform 1, the search unit 14 decides whether another speech unit waveform has identical or similar waveform. Then, a speech unit waveform 106 ("ha") divided from the speech waveform 2 is decided to be identical or similar to the speech unit waveform 101. In the same way, as to each of speech unit waveforms except for the speech unit waveform 101, the search unit 14 decides whether other speech unit waveform has identical or similar waveform.

Then, as to a speech unit waveform 102 ("k a t e I r u k at a n i P") divided from the speech waveform 1, a speech unit waveform 105 ("k a t e i r u k a t a n i P") divided from the speech waveform 2, and a speech unit waveform 109 ("k a t e r u k at a n i P") divided from the speech waveform 3, these speech unit waveforms are decided to be identical or similar.

Furthermore, as to a speech unit waveform 103 ("t a i n o j yo h o o d e s") divided from the speech waveform 1, a speech unit waveform 107 ("t a in o j yo h o o d e s") divided from the speech waveform 2, and a speech unit waveform 110 ("t a i n o j yo h o o d e s") divided from the speech waveform 3, these speech unit waveforms are decided to be identical or similar.

Furthermore, as to a speech unit waveform 104 ("t a h o o m e N e m u") divided from the speech waveform 2 and a speech unit waveform 108 ("t a h o o m e N e m u") divided from the speech waveform 3, these speech unit waveforms are decided to be identical or similar.

The search unit 14 selects the speech unit waveform 101 as a first representative speech unit waveform of the speech unit waveforms 101 and 106. In the same way, the search unit 14 selects the speech unit waveform 102 as a second representative speech unit waveform of the speech unit waveforms 102, 105 and 109. Furthermore, the search unit 14 selects the speech unit waveform 103 as a third representative speech unit waveform of the speech unit waveforms 103, 107 and 110.

Among at least two speech unit waveforms having identical or similar waveforms, the search unit 14 removes (deletes) all speech unit waveforms not selected as the representative speech unit waveform. For example, the search unit 14 removes a speech unit waveform 106 not selected as the first representative speech unit waveform. In the same way, the search unit 14 removes speech unit waveforms 105 and 109 each not selected as the second representative speech unit waveform. Furthermore, the search unit 14 removes speech unit waveforms 107 and 110 each not selected as the third representative speech unit waveform.

Figure 9:
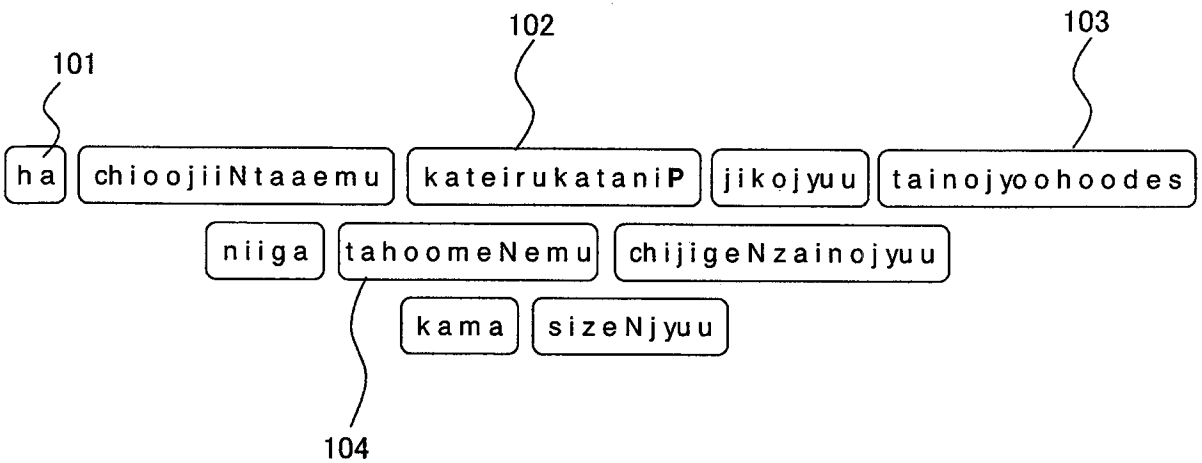
FIG. 9 is one example of speech unit waveforms decided by a search unit 14 in FIG. 1.

As shown in FIG. 9, after decision processing by the search unit 14, the search unit 14 stores the representative speech unit waveforms, and speech unit waveforms not identical or not similar to other speech unit waveforms. In FIG. 9, as the representative speech unit waveforms, speech unit waveforms 101, 102, 103 and 104 are remained. As the speech unit waveforms not identical or not similar to other speech unit waveforms, a speech unit waveform ("ch i o o j i i N t a a e m u") and a speech unit waveform ("j i k o j yu u") each divided from the speech waveform 1 are remained. A speech unit waveform ("n i i g a") and a speech unit waveform ("ch i j i g e N z a i n o j yu u") each divided from the speech waveform 2 are remained. Furthermore, a speech unit waveform ("k a m a") and a speech unit waveform ("s i z e N j yu u") each divided from the speech waveform 3 are remained. The search unit 14 stores these remained speech unit waveforms into the storage unit 50 (S306), and processing is completed. Phonologic information and prosody information corresponding to these speech unit waveforms may be stored in the storage unit 50. In this case, the division unit 13 divides the phonologic information and the prosody information to correspond with each speech unit waveform.

As mentioned-above, in the first embodiment, speech units having high usage efficiency can be created, and total data quantity of speech units to be stored can be easily reduced. Furthermore, from all speech units, at least two speech units having identical or similar waveforms are searched. Accordingly, degradation of sound quality can be suppressed.

Moreover, in the first embodiment, processing in case of Japanese is explained. However, for example, the same processing can be performed in case of English.

As shown in FIGS. 10A~10D, the speech editing apparatus 1 processes English texts. For example, at S301 in FIG. 3, the input unit 11 inputs "Turn right at the next exit, then immediately left." (text 4), "Turn left at the next intersection." (text 5) and "Turn right at the intersection, then immediately right again." (text 6), from a user.

At S302, the generation unit 12 generates a speech waveform 4 corresponding to the text 4, a speech waveform 5 corresponding to the text 5, and a speech waveform 6 corresponding to the text 6. Letters described with speech waveforms 4~6 represent phonemes. As shown in FIG. 11, IPA (International Phonetic Alphabet) corresponds with phoneme letters in FIGS. 10A~10D.

At S303, as mentioned-above, the division unit 13 divides the speech waveform into speech unit waveforms at a predetermined time. For example, the division unit 13 divides the speech waveform 4 (represented as phoneme sequence in FIG. 10B) into eight speech unit waveforms, "t 3R n r aI", "t A", "tc D @ n E", "k s", "t E", "k s I t P", "D E N I m I d I @", "tc l I l E f t". In the phoneme sequence, capital letter "P" represents phoneme letters "PAUSE".

In the same way, the division unit 13 divides the speech waveform 5 into seven speech unit waveforms, "t 3R n l E f", "t A", "tc D @ n E", "k s", "t I n", "t 3R s E", "k S @ n". Furthermore, the division unit 13 divides the speech waveform 6 into eight speech unit waveforms, "t 3R n r aI", "t A", "tc D @ l n", "t 3R s E", "k S @ n P", "D E n I m i d i @", "tc l i r aI", "t @ g E n".

At S304, the search unit 304 searches speech unit waveforms having identical or similar waveforms from all speech unit waveforms. For example, the search unit 14 decides that a speech unit waveform 201 (divided from the speech waveform 4) and a speech unit waveform 211 (divided from the speech waveform 6) are identical or similar. In the same way, the search unit 14 decides that a speech unit waveform 202 (divided from the speech waveform 4), a speech unit waveform 206 (divided from the speech waveform 5) and a speech unit waveform 212 (divided from the speech waveform 6) are identical or similar. The search unit 14 decides that a speech unit waveform 203 (divided from the speech waveform 4) and a speech unit waveform 207 (divided from the speech waveform 5) are identical or similar.

Furthermore, the search unit 14 decides that a speech unit waveform 204 (divided from the speech waveform 4) and a speech unit waveform 208 (divided from the speech waveform 5) are identical or similar. The search unit 14 decides that a speech unit waveform 205 (divided from the speech waveform 4) and a speech unit waveform 215 (divided from the speech waveform 6) are identical or similar. The search unit 14 decides that a speech unit waveform 209 (divided from the speech waveform 5) and a speech unit waveform 213 (divided from the speech waveform 6) are identical or similar. The search unit 14 decides that a speech unit waveform 210 (divided from the speech waveform 5) and a speech unit waveform 214 (divided from the speech waveform 6) are identical or similar.

At S305, the search unit 14 selects one speech unit waveform from at least two speech unit waveforms having identical or similar waveforms, and removes (deletes) other speech unit waveforms not selected. For example, the search unit 14 selects the speech unit waveform 201 as a fourth representative speech unit waveform of the speech unit waveforms 201 and 211. In the same way, the search unit 14 selects the speech unit waveform 202 as a fifth representative speech unit waveform of the speech unit waveforms 202, 206 and 212. The search unit 14 selects the speech unit waveform 203 as a sixth representative speech unit waveform of the speech unit waveforms 203 and 207. The search unit 14 selects the speech unit waveform 204 as a seventh representative speech unit waveform of the speech unit waveforms 204 and 208. The search unit 14 selects the speech unit waveform 205 as an eighth representative speech unit waveform of the speech unit waveforms 205 and 215. The search unit 14 selects the speech unit waveform 209 as a ninth representative speech unit waveform of the speech unit waveforms 209 and 213. The search unit 14 selects the speech unit waveform 210 as a tenth representative speech unit waveform of the speech unit waveforms 210 and 214.

The search unit 14 removes (deletes) other speech unit waveforms (not selected as the representative speech unit waveform) in the at least two speech unit waveforms having identical or similar waveforms. For example, the search unit 14 removes the speech unit waveform 211 not selected as the fourth representative speech unit waveform. In the same way, the search unit 14 removes the speech unit waveforms 206 and 212 each not selected as the fifth representative speech unit waveform. The search unit 14 removes the speech unit waveform 207 not selected as the sixth representative speech unit waveform. The search unit 14 removes the speech unit waveform 208 not selected as the seventh representative speech unit waveform. The search unit 14 removes the speech unit waveform 215 not selected as the eighth representative speech unit waveform. The search unit 14 removes the speech unit waveform 213 not selected as the ninth representative speech unit waveform. The search unit 14 removes the speech unit waveform 214 not selected as the tenth representative speech unit waveform.

At S306, the search unit 14 stores speech unit waveforms remained without deletion, into the storage unit 50. In this way, in the first embodiment, the same processing can be performed in case of English text.

In the first embodiment, the search unit 14 selects the representative speech unit waveform from speech unit waveforms. However, if at least two speech unit waveforms having identical or similar waveforms is included in all speech unit waveforms, the search unit 14 may create a representative speech unit waveform based on the at least two speech unit waveforms. For example, from prosody information of each speech unit waveform, the search unit 14 may newly create a speech unit waveform having a weighted average of duration and a weighted average of fundamental frequency. Briefly, as to prosody information of identical or similar speech unit waveforms, the search unit 14 determines averaged prosody information by calculating a weighted sum of duration and a weighted sum of fundamental frequency (included in the prosody information). Using speech synthesis means such as text-to-speech synthesis method, the search unit 14 may create a representative speech unit waveform by re-synthesizing speech unit waveforms from the averaged prosody information.

(Modification 1)

Figure 12:
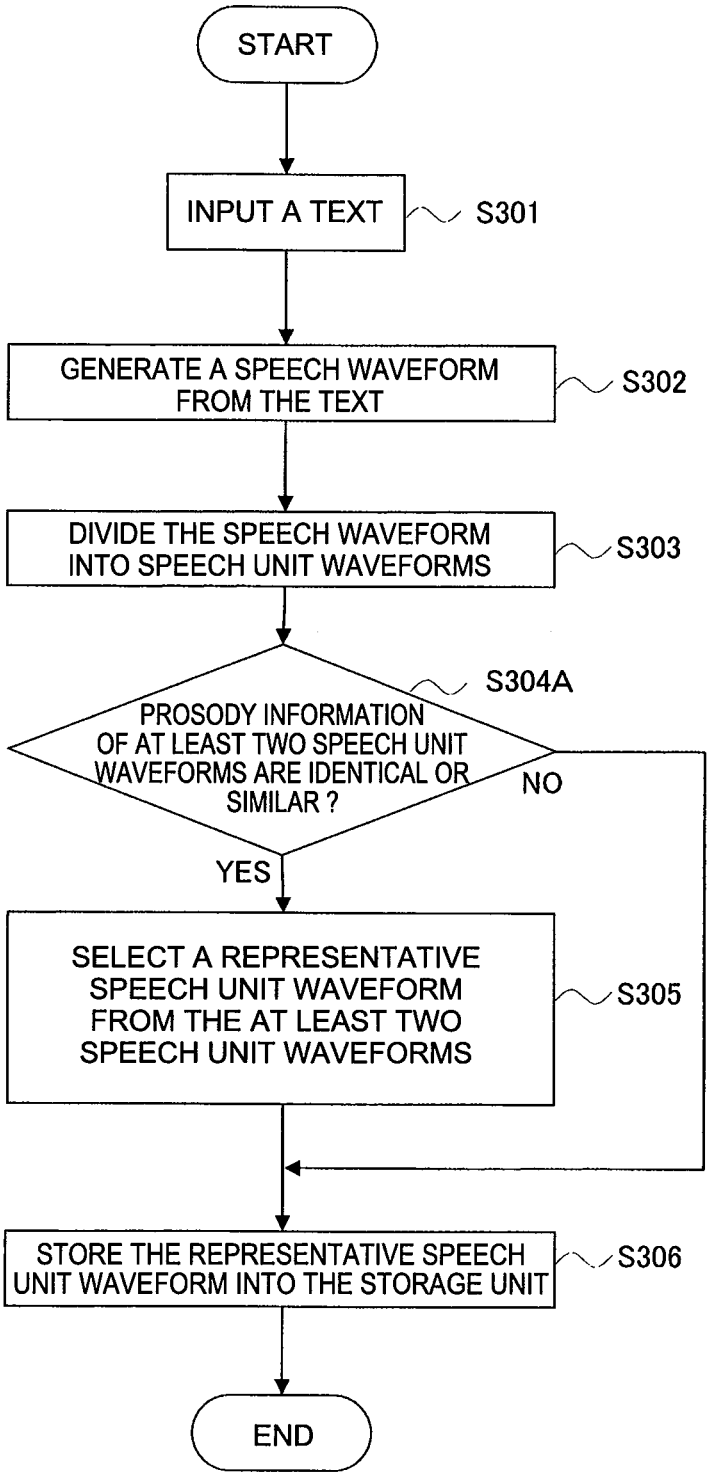
FIG. 12 is a flow chart of processing of the speech editing apparatus 1 according to modification 1 of the first embodiment.

In the first embodiment, the search unit 14 searches speech unit waveforms having identical or similar waveforms. However, in the modification 1, the search unit 14 searches speech units having identical or similar prosody information. In FIG. 12 as a flowchart of the modification 1, S304 of FIG. 3 is replaced with S304A. The search unit 14 decides whether at least two speech unit waveforms having identical or similar prosody information are included in all speech unit waveforms (S304A). As a meaning that prosody information is identical, phoneme sequences of speech unit waveforms (to be compared) are identical, durations of each phoneme in the phoneme sequences are identical, and F0 sequences of each phoneme are identical. As a meaning that prosody information is similar, phoneme sequences of speech unit waveforms (to be compared) are identical, a difference between durations of corresponding phonemes in the phoneme sequences is within a predetermined threshold, and a difference between F0 sequences of corresponding phonemes is within a predetermined threshold.

Above-mentioned condition that "waveforms are identical or similar" is called a condition 1. Above-mentioned condition that "prosody information is identical or similar" is called a condition 2. If the condition 1 is satisfied, the condition 2 is satisfied. However, even if the condition 2 is satisfied, the condition 1 is not always satisfied.

Briefly, the search unit 14 decides whether the condition 2 is satisfied. In this case, in comparison with decision using the condition 1, total data quantity of speech units to be stored in the storage unit 50 can be reduced.

(Modification 2)

Figure 13:
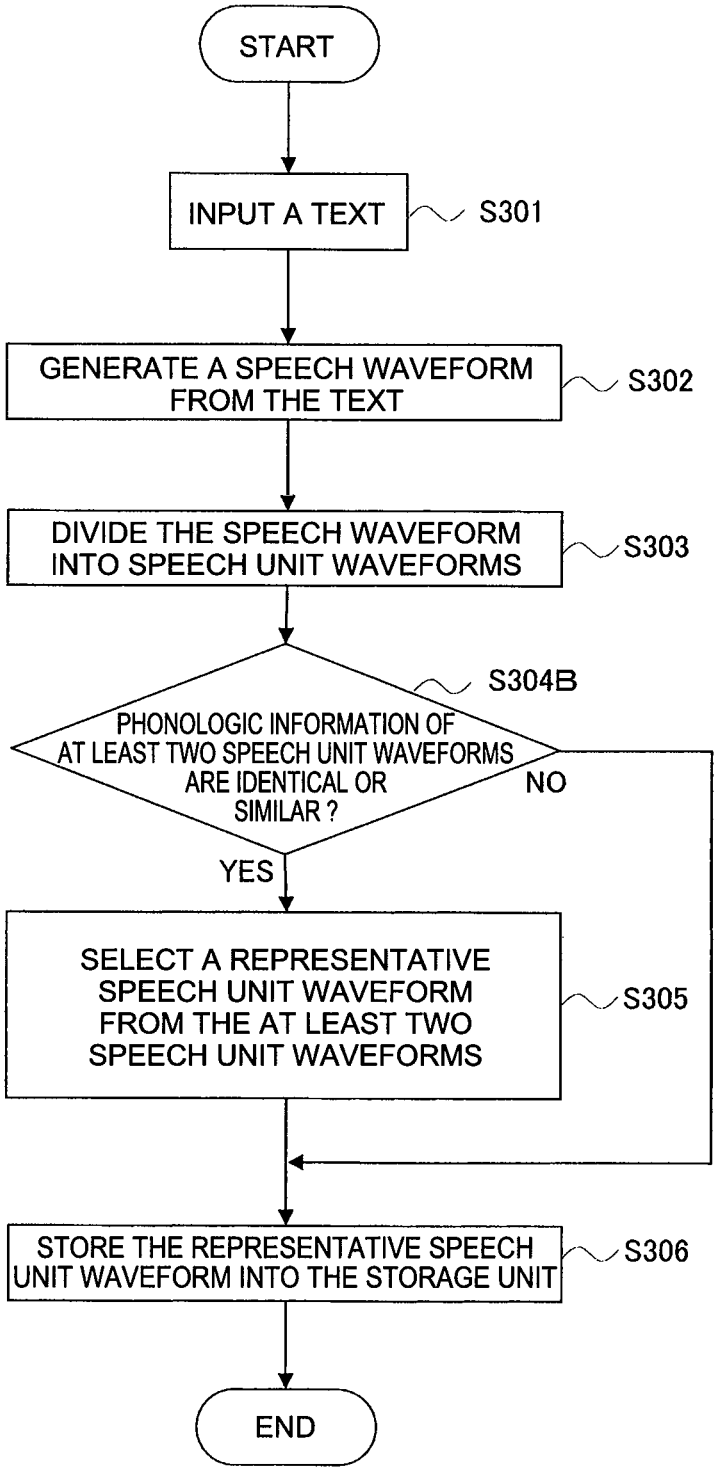
FIG. 13 is a flow chart of processing of the speech editing apparatus 1 according to modification 2 of the first embodiment.

In the modification 2, the search unit 14 searches speech units having identical or similar phonologic information. In FIG. 13 as a flow chart of the modification 2, S304 of FIG. 3 is replaced with S304B. The search unit 14 decides whether at least two speech unit waveforms having identical or similar phonologic information are included in all speech unit waveforms (S304B). As a meaning that phonologic information is identical, phoneme sequences of speech unit waveforms (to be compared) are identical, and accent phonemes of the speech unit waveforms are identical.

Above-mentioned condition that "phonologic information are identical or similar" is called a condition 3. If the condition 2 is satisfied, the condition 3 is satisfied. However, even if the condition 3 is satisfied, the condition 2 is not always satisfied.

Briefly, the search unit 14 decides whether the condition 3 is satisfied. In this case, in comparison with decision using the condition 1 or 2, total data quantity of speech units to be stored in the storage unit 50 can be reduced.

Moreover, except for the phoneme sequence and the accent phoneme, for example, the phonologic information may include information of a boundary of accent phrase. The boundary of accent phrase represents a boundary between adjacent accent phrases including an accent. The condition 3 may include a condition that the boundaries of two accent phrases are identical.

(Modification 3)

In above modifications, as to a speech waveform generated by the generation unit 12, the division unit 13 divides the speech unit. However, division method is not limited to this. For example, following method can be used.

From an input text, the generation unit 12 generates phonologic information (including phoneme sequence in which text is represented as phonemes) and prosody information (including duration of each phoneme and time change of fundamental frequency). Based on the phoneme sequence and the duration, the division unit 13 divides the prosody information into speech units as a unit of the prosody information. For example, the prosody information may be divided at a mediate time of unvoiced plosive sound (or pause phoneme). Among a plurality of speech units divided, the search unit 14 searches at least two speech units of which at least any of the phoneme sequence, the duration and the time change of fundamental frequency, are identical or similar. Briefly, based on phonologic information and prosody information included in a representative speech unit, by using speech synthesis method such as text-to-speech synthesis method, the search unit 14 generates a synthesized speech waveform, i.e., a speech waveform corresponding to the text. The search unit 14 stores the speech waveform into the storage unit 50.

The Second Embodiment

As to a speech editing apparatus (not shown in Fig.) according to the second embodiment, by using the condition 1 (the most strict condition), speech unit waveforms having identical or similar feature are searched. When data quantity of speech unit waveforms (remained after searching) is below a predetermined threshold, the speech unit waveforms are stored into the storage unit 50. When data quantity of speech unit waveforms (remained after searching) is not below a predetermined threshold, by using the condition 2 (the second strict condition), speech unit waveforms having identical or similar feature are searched. By repeating this processing, data quantity of speech unit waveforms (to be stored into the storage unit 50) is controlled. In the second embodiment, processing of the search unit 14 is different from the first embodiment.

Figure 14:
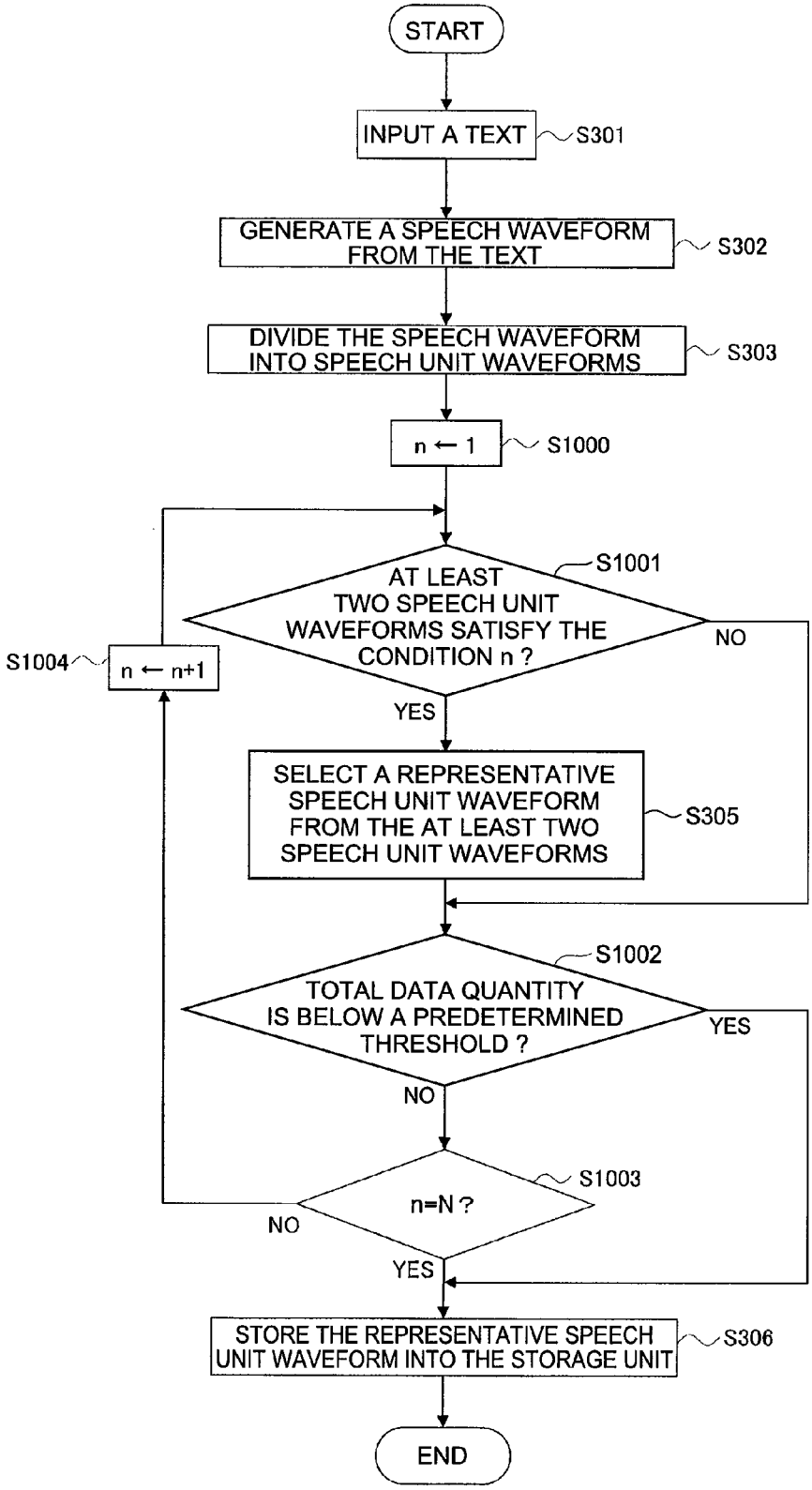
FIG. 14 is a flow chart of processing of the speech editing apparatus 1 according to the second embodiment.

In FIG. 14 as a flow chart of processing of the second embodiment, steps S301~S303, S305 and S306, are same as those in flow chart of the first embodiment. Hereinafter, steps different from the first embodiment are explained.

After receiving all speech unit waveforms from the division unit 13, the search unit 14 sets an initial value of condition n (n=1, 2, . . . , N (N=3 in this example)) as "n=1" (S1000). The search unit 14 decides whether at least two speech unit waveforms satisfy the condition n (S1001). In the same way as the modification 1 and 2, if the condition n is satisfied, the conditions (n+1)~(n+(N−1)) are satisfied.

In case of Yes at S1001, the search unit 14 executes processing of S305, and decides whether total data quantity of speech unit waveforms (remained without deletion) is below a predetermined threshold (S1002). In case of No at S1001, the search unit 14 does not execute processing of S305, and processing is forwarded to S1002.

In case of Yes at S1002, the search unit 14 stores the speech unit waveforms (remained without deletion) into the storage unit 50 (S306), and the processing is completed. In case of No at S1002, the search unit 14 decides whether to be "n=N" (S1003).

In case of Yes at S1003, the search unit 14 stores the speech unit waveforms (remained without deletion) into the storage unit 50 (S306), and the processing is completed. In case of Yes at S1003, the search unit 14 increments n by "1" (S1004), and the processing is forwarded to S1001.

In this way, as to the second embodiment, data quantity of speech unit waveforms (to be stored into the storage unit 50) can be gradually limited.

The Third Embodiment

As to a speech synthesis apparatus 3 according to the third embodiment, by using speech unit waveforms stored in the storage unit 50 (as mentioned in the first and second embodiments), speech is artificially synthesized.

Figure 15:
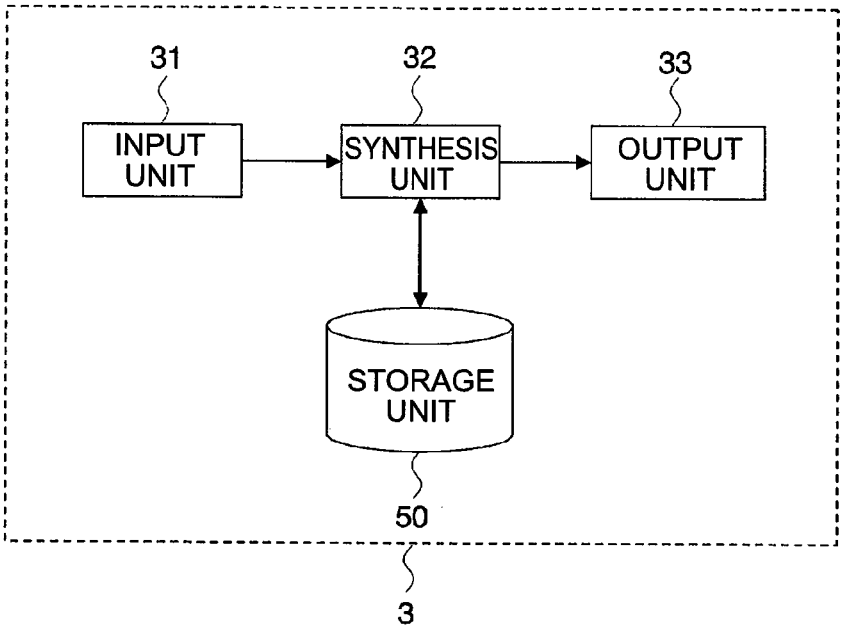
FIG. 15 is a block diagram of a speech synthesis apparatus 3 according to the third embodiment.

As shown in FIG. 15, the speech synthesis apparatus 3 includes the memory unit 50, an input unit 31, a synthesis unit 32, and an output unit 33. The storage unit 50 stores speech unit waveforms and phonologic information thereof as explained in the first and second embodiments. The input unit 31 inputs a text from a user. The synthesis unit 32 generates pronunciation data of the text. The pronunciation data includes data sequence of phonologic information of the text. The synthesis unit 32 compares the pronunciation data with the phonologic information stored in the storage unit 50, and synthesizes speech waveforms by concatenating speech unit waveforms corresponding to the pronunciation data. The output unit 33 outputs a speech converted from the speech waveforms. In this case, the synthesis unit 32 may be realized by a CPU (Central Processing Unit) and a memory used with the CPU.

As mentioned-above, in the third embodiment, the speech synthesis apparatus using speech units having high usage efficiency can be presented.

While certain embodiments have been described, these embodiments have been presented by way of examples only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A method for editing speech, comprising:

inputting a plurality of texts to generate representative speech unit waveforms to be used by a phrase concatenation based speech synthesis method;

generating speech information from the texts, the speech information comprising phonologic information and prosody information;

generating speech waveforms from the speech information by text-to-speech synthesis;

dividing the speech waveforms into a plurality of speech unit waveforms based on the phonologic information;

searching at least two speech unit waveforms from the plurality of speech unit waveforms, wherein the at least two speech unit waveforms are identical or similar;

selecting a representative speech unit waveform from the at least two speech unit waveforms; and storing the representative speech unit waveform into a memory.

2. The method according to claim 1, wherein the dividing comprises dividing the speech waveforms into the plurality of speech unit waveforms based on amplitudes of the speech waveforms.

3. The method according to claim 2, further comprising:

generating the phonologic information comprising a phoneme sequence that represents the text as phonemes, wherein the phoneme sequence comprises an unvoiced sound and a pause sound representing silence, the dividing comprises dividing the speech waveforms at a time in a section corresponding to the unvoiced sound or the pause sound, and the time corresponds to an absolute value of the amplitude being below a threshold.

4. The method according to claim 3, further comprising:

generating the prosody information comprising a duration and a fundamental frequency of each of the phonemes, and generating the representative speech unit waveform by averaging at least one of the duration and the fundamental frequency in the at least two speech unit waveforms.

5. An apparatus for editing speech, comprising:

an input unit configured to input a plurality of texts to generate representative speech unit waveforms by a phrase concatenation based speech synthesis method;

a generation unit configured to generate speech information from the texts, the speech information comprising phonologic information and prosody information, and to generate speech waveforms from the speech information by text-to-speech synthesis;

a division unit configured to divide the speech waveforms into a plurality of speech unit waveforms based on the phonologic information;

a search unit configured to search at least two speech unit waveforms, from the plurality of speech unit waveforms, that are identical or similar, and to select a representative speech unit waveform from the at least two speech unit waveforms; and a storing unit configured to store the representative speech unit waveform.

6. A method for editing speech, comprising:

inputting a plurality of texts to generate representative speech unit waveforms to be used by a phrase concatenation based speech synthesis method;

generating speech information from the texts, the speech information comprising phonologic information and prosody information;

generating speech waveforms from the speech information by text-to-speech synthesis;

dividing the speech waveforms into a plurality of speech unit waveforms based on the phonologic information;

searching at least two speech unit waveforms, from the plurality of speech unit waveforms, wherein subsets of the phonologic information and the prosody information respectively corresponding to the at least two speech unit waveforms are identical or similar;

selecting a representative speech unit waveform from the at least two speech unit waveforms; and storing the representative speech unit waveform into a memory.

7. A method for editing speech, comprising:

inputting a plurality of texts to generate representative speech unit waveforms to be used by a phrase concatenation based speech synthesis method;

generating speech information from the texts, the speech information comprising phonologic information and prosody information;

dividing the speech information into a plurality of speech information units based on the phonologic information;

searching at least two speech information units from the plurality of speech information units, wherein subsets of the phonologic information and the prosody information in the at least two speech information units are respectively identical or similar;

generating a representative speech information unit from the at least two speech information units;

generating a representative speech unit waveform corresponding to the representative speech information unit by text-to-speech synthesis; and storing the representative speech unit waveform into a memory.

* * * * *